US010682559B1

(12) United States Patent
Parker

(10) Patent No.: US 10,682,559 B1
(45) Date of Patent: Jun. 16, 2020

(54) SWING TRAINING APPARATUS AND METHOD OF USING THE SAME

(71) Applicant: Adele Parker, Albuquerque, NM (US)

(72) Inventor: Adele Parker, Albuquerque, NM (US)

( * ) Notice: Subject to any disclaimer, the term of this patent is extended or adjusted under 35 U.S.C. 154(b) by 0 days.

(21) Appl. No.: 16/448,854

(22) Filed: Jun. 21, 2019

(51) Int. Cl.
*A63B 69/40* (2006.01)
*A63B 69/00* (2006.01)
*A63B 69/36* (2006.01)

(52) U.S. Cl.
CPC ..... *A63B 69/0059* (2013.01); *A63B 69/0002* (2013.01); *A63B 69/36* (2013.01); *A63B 2069/0008* (2013.01)

(58) Field of Classification Search
CPC ..... A63B 2069/0008; A63B 2209/08; A63B 69/0002; A63B 2069/0006; A63B 69/00; A63B 2071/0625; A63B 2209/10; A63B 2220/833; A63B 69/0059; A63B 2102/18; A63B 69/3608; A63B 69/36; A42B 3/0433
USPC ..... 473/211, 268, 422, 409
See application file for complete search history.

(56) References Cited

U.S. PATENT DOCUMENTS 4,300,765 A * 11/1981 Stringham ..... A63B 69/0002 473/211
4,392,830 A * 7/1983 Salzman ..... A63B 69/00 434/258
5,428,846 A * 7/1995 Socci ..... A42B 3/0433 2/425
5,447,305 A * 9/1995 Socci ..... A42B 3/0433 473/458
5,474,298 A 12/1995 Lindsay
5,713,804 A * 2/1998 Socci ..... A42B 3/0433 473/211
7,038,855 B2 5/2006 French
2006/0150304 A1 7/2006 Bentz
2008/0028500 A1 2/2008 Bentz
2008/0287205 A1 11/2008 Katayama
2011/0251802 A1* 10/2011 Song ..... A63B 69/004 702/41
2017/0157487 A1 6/2017 Faucette
2018/0199650 A1 7/2018 Kim

FOREIGN PATENT DOCUMENTS

KR 20090036651 4/2009

* cited by examiner

*Primary Examiner* — Nini F Legesse
(74) *Attorney, Agent, or Firm* — Marcus C. Dawes

(57) ABSTRACT

A device to encourage players to keep their chin down after finishing their swing in sports such as baseball or golf. The device includes a magnet disposed on a chin portion of the device. A separate metal button is removably disposed on the user's back shoulder. While the user is swinging a bat or other piece of sporting equipment, the magnet moves toward and makes contact with the metal button located on the user's shoulder. As the magnet makes contact with the button, an audible "click" sound is emitted which confirms to the user that their head has stayed in the down position during their swing and after hitting the ball. By delaying any lifting of the head to watch the ball after it has been hit encourages the user to keep their head down which thereby improves their ability to see the ball and make contact with it.

20 Claims, 5 Drawing Sheets

FIG. 3
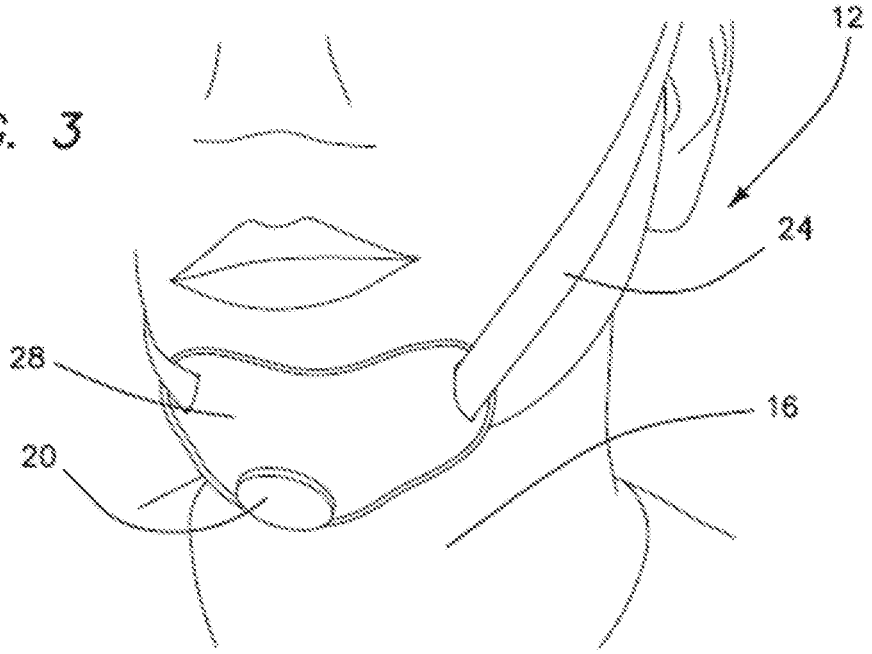
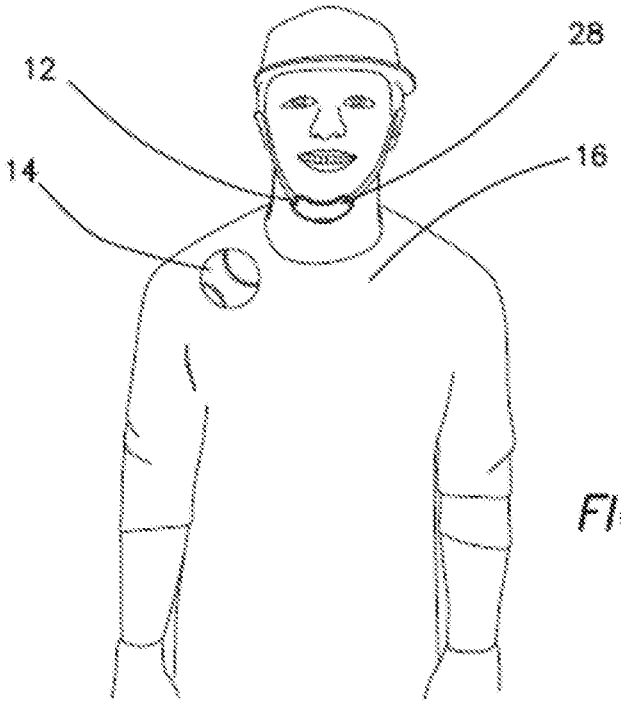
FIG. 4

SWING TRAINING APPARATUS AND METHOD OF USING THE SAME

BACKGROUND

Field of the Technology

The invention relates to the field of sporting technology and sporting equipment, specifically to devices and methods for improving a user's ability to keep their head down and thus train their eye or line of sight while using a baseball bat, golf club, or other piece of sporting equipment.

Description of the Prior Art

When playing a game or competing in an athletic activity such as baseball or golf, the goal of many players is to drive the baseball or golf ball in front of them to the best of their ability. In order to do so however, a highly defined sequence of physical motions must take place if the player has any chance of achieving the desired degree of contact with the ball. Arguably the most important of these defined sequence of physical steps or motions is for the player to maintain eye contact with the ball throughout their swing. A particular problem develops in many players however who wish to hit the ball with a large amount of force. Specifically, a player in an effort to swing either a baseball bat or golf club as fast as possible will often pull their shoulders and back away from the ball in order to generate as much force as possible. However when the player pulls their shoulders away, their head also comes up and away from the ball, thereby making the player lose visual contact with the ball that they are trying to hit. This is true even in golf where the golf ball remains in a stationary position as the player is performing their swing.

To prevent pulling their head off the ball and losing visual contact with it, players have adopted several techniques for breaking them of the habit of not keeping their eye on the ball during their swing. In baseball and golf, players will often practice hitting a ball off of a tee while attempting to keep their head down during their swing. Some players will go further and place an object on their head such as a glove when they perform their swing. If the glove falls off during their swing, the player is notified that their head has come off or pulled away from the ball. Conversely, if the glove remains on their head during and after their swing, the player then knows that their head stayed down. Additionally, another technique involves the player biting or holding a piece of their shirt or clothing in their mouth while they perform their swing. The player then knows if their head comes up or not depending on how much their shirt or clothing is pulled.

While these techniques can help some players some of the time, they are not without their respective short comings. For example, hitting off a tee does not provide any outside indication that their head has come up off the ball during their swing. Placing a glove or other object in far from precise and can be inconsistently used from swing to swing. Biting or holding clothing in the player's mouth during a swing can be uncomfortable or even dangerous.

What is needed therefore is a device and method for a player to practice their swing while ensuring that the player maintains their head down through the duration of the swing thereby improving the player's ability to see the ball and make sufficient contact with it. The device should be comfortable to wear and not obstruct the player in any way and should allow the player to perform consistent repetitions so that the player forms a habit of keeping their head down during a swing even when the player is not wearing the device.

BRIEF SUMMARY

The current invention includes an apparatus for assisting a user perform a swing training regimen. The apparatus includes a removable guard which is attached to a head or chin portion of the user and a removable button attached to the user. The guard itself includes a means for temporarily attaching to the button when the guard and button are brought in close proximity to one another during a performance of the swing training regimen.

In one embodiment, the means for attaching the guard includes a magnet that is disposed on a distal portion of the guard.

In another embodiment, the apparatus includes a head piece which fits around the head and chin of the user. Here, the guard is specifically attached to the head piece so that it is disposed about the chin of the user when the head piece is worn by the user. Additionally, the head piece may include a head band which is attached to a chin strap, wherein the guard is disposed on a center portion of the chin strap.

In yet another embodiment, the button may be removably attached to a shoulder portion of the user.

In a related embodiment, the button is specifically comprised of ferromagnetic material.

In one embodiment, the means for attaching the guard to the button also emits an audible signal when the guard and the button are brought in close proximity to one another during the performance of the swing training regimen.

The invention further provides a method for assisting a user perform a swing training regimen. The method includes disposing an automatic means for attaching on a head or chin portion of the user and then disposing a removable surface on a shoulder portion of the user. The user then performs a swinging motion which brings the shoulder portion of the user into proximity with the head or chin portion of the user. If the head or chin portion of the user has remained in close proximity to the shoulder portion of the user during the performance of the swinging motion, means for attaching disposed on the head or chin portion of the user automatically engages to the surface disposed on the shoulder portion of the user.

In one embodiment, the method also includes preventing engagement between the means for attaching disposed on the head or chin portion of the user and the surface disposed on the shoulder portion of the user if the head or chin portion of the user is maintained at a distance from the shoulder portion of the user.

In another embodiment, the step of automatically engaging the means for attaching disposed on the head or chin portion of the user to the surface disposed on the shoulder portion of the user if the head or chin portion of the user has remained in close proximity to the shoulder portion of the user during the performance of the swinging motion specifically includes adhering the means for attaching disposed on the head or chin portion of the user automatically to the surface disposed on the shoulder portion of the user if the means for attaching has made contact with the surface. Relatedly, the means for attaching may maintain contact with the surface disposed on the shoulder portion of the user throughout the duration of the performed swinging motion. Additionally, the method further includes separating the means for attaching disposed on the head or chin portion of the user from the surface disposed on the shoulder portion of the user by pulling the means for attaching and the surface away from each other until the means for attaching disengages from the surface.

In yet another embodiment, the method step of disposing an automatic means for attaching on a head or chin portion of the user includes disposing a guard at or around the chin of the user, specifically on a distal end of the guard. The guard is placed around the head and chin of the user by stretching a head band around the head of the user and then adjusting a chin strap attached to the head band so that the guard which is disposed on a center portion of the chin strap is also disposed at or around the chin of the user.

In yet another embodiment, disposing the removable surface on a shoulder portion of the user specifically includes adhering the removable surface to a portion of the user's clothing which disposed at the shoulder portion of the user.

Alternatively, disposing the removable surface on a shoulder portion of the user may include inserting a portion of the removable surface through a portion of the user's clothing which is disposed at the shoulder portion of the user.

In another embodiment, the method further includes emitting an audio or visual signal to the user when the means for attaching disposed on the head or chin portion of the user has engaged with the surface disposed on the shoulder portion of the user.

In a related embodiment, the step of adhering the coupling means disposed on the head or chin portion of the user automatically to the surface disposed on the shoulder portion of the user if the coupling means has made contact with the surface specifically includes the means for attaching making contact with the surface with a magnet.

In current invention also provides a system for assisting a user perform a swing training regimen. The system specifically includes a head piece with a chin strap, a guard coupled to the chin strap, a means for attaching located at a distal portion of the guard, and a removable button which configured to be worn by the user at a shoulder portion of the user's body.

In one specific embodiment, the means for attaching specifically includes a magnet, while the removable button is made of a ferromagnetic material.

While the apparatus and method has or will be described for the sake of grammatical fluidity with functional explanations, it is to be expressly understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112 are to be accorded full statutory equivalents under 35 USC 112. The disclosure can be better visualized by turning now to the following drawings wherein like elements are referenced by like numerals.

BRIEF DESCRIPTION OF THE DRAWINGS

FIG. 3 is a magnified frontal view of the head piece portion of the apparatus highlighting the chin guard portion of the head piece.

FIG. 4 is a frontal view of the current apparatus while being worn by a user including a button which is substantially disposed on the user's back or rear shoulder.

The disclosure and its various embodiments can now be better understood by turning to the following detailed description of the preferred embodiments which are presented as illustrated examples of the embodiments defined in the claims. It is expressly understood that the embodiments as defined by the claims may be broader than the illustrated embodiments described below.

DETAILED DESCRIPTION OF THE PREFERRED EMBODIMENTS

Figure 1:
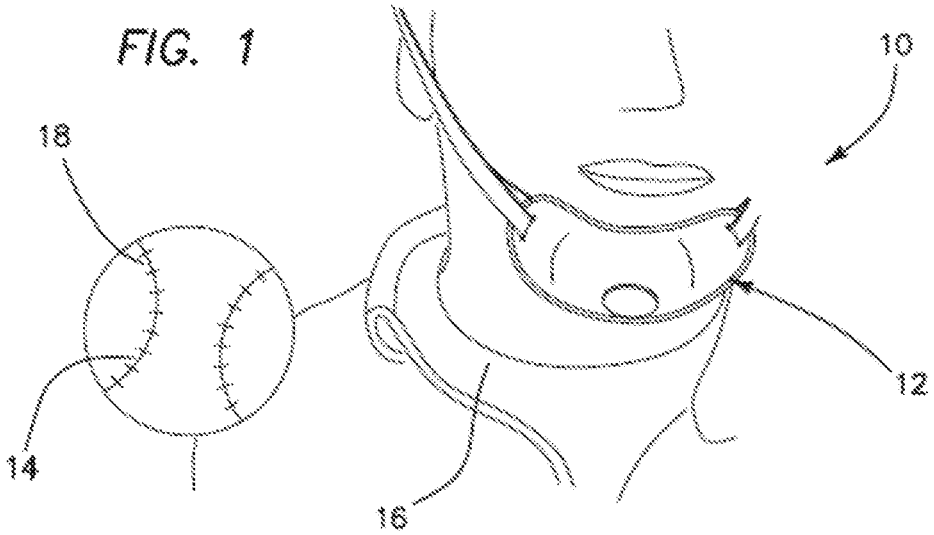
FIG. 1 is a frontal view of the current apparatus while being worn by a user.

The current invention is a swing training apparatus and is denoted generally by reference numeral 10 as seen in the figures. As shown in FIG. 1, the apparatus 10 comprises a head piece 12 and a shoulder button 14. Both the head piece 12 and shoulder button 14 are removable in the sense that they may be selectively worn or disposed by a user/player 16 at the head and shoulder portions of the user 16, respectively. The shoulder button 14 is comprised of a metal disk or metal surface which may be enveloped or surrounded in a cover 18. The metal disk or surface of the shoulder button 14 is preferably comprised of iron, nickel, cobalt, or other related metal alloys, however any ferromagnetic material may be used without departing from the original spirit and scope of the invention. The cover 18 is in turn comprised of a polyester film such as Mylar®, however in alternative embodiments, other non-magnetic yet durable materials such as plastic films, cloth, or paper may be used. In an alternative embodiment, both the metal surface in the shoulder button 14 and the cover 18 are comprised of ferromagnetic materials selectively chosen to interact with a magnet 20 as is discussed further below.

Figure 2:
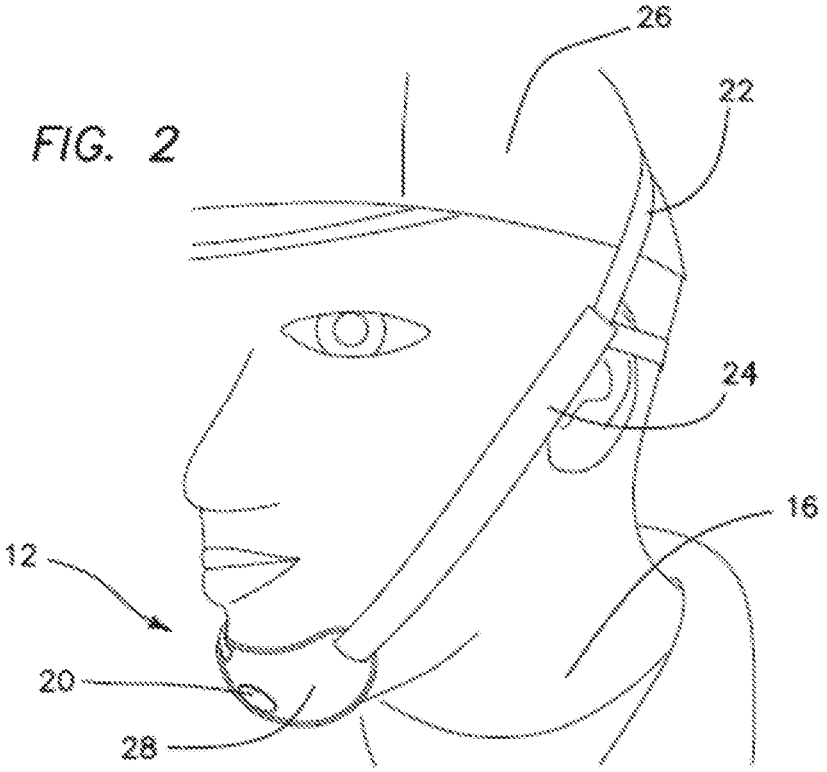
FIG. 2 is a side perspective view of the head piece portion of the apparatus seen in FIG. 1 while being worn by a user.

Greater detail of the head piece 12 may be had by turning to FIGS. 2 and 3. The head piece 12 comprises a head band 22 coupled to a chin strap 24. The head band 22 is sized and configured to fit around the back of the head of the user 16 when worn while the chin strap 24 extends from near the ear of the user, around the user's chin, and then to same spot near the ear of the user on the opposite side of the head. Both the chin strap 24 and the head band 22 are comprised of soft, stretchable, or elastic fabric so as to properly fit the head of any sized user, however other materials or fabrics such as leather, nylon, or other polyester blends may be used without departing from the original spirit and scope of the invention.

The head band 22 is sufficiently resilient or stretchable so as to comfortably fit over a hat 26 being worn by the user 16.

Disposed on a center portion of the chin strap 24 is a guard 28 which is sized to fit on or over the chin of the user 16. Alternatively, the guard 28 may rest at or below the user's chin or jaw line. Disposed on the most distal portion of the guard 28 is a strong magnet 20 which is capable of magnetically interacting with the material comprising the shoulder button 14. The magnet 20 may be a disk or coin magnet as seen in FIGS. 1-3, or alternatively, may be a bar magnet or other suitably shaped or sized magnet as is known in the art.

Figure 6A:
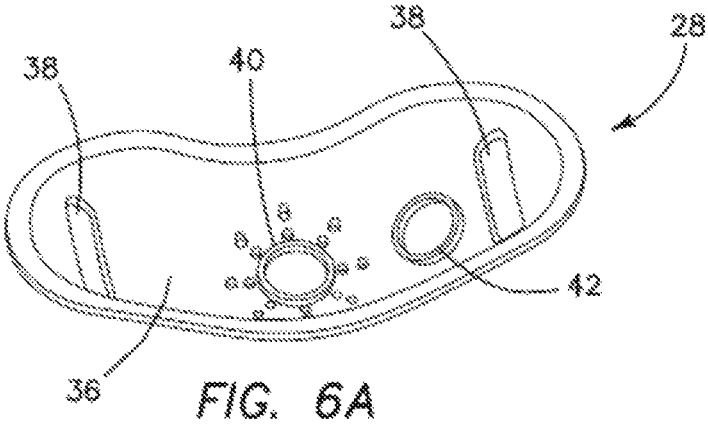
FIG. 6A is a top down perspective view of the inside surface of the chin guard.
Figure 6B:
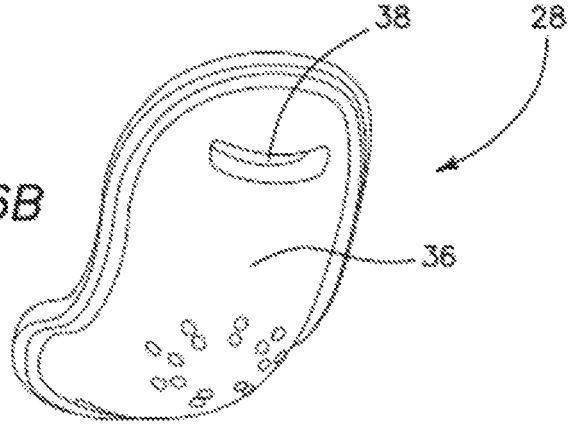
FIG. 6B is a bottom perspective view of the chin guard seen in FIG. 6A.
Figure 6C:
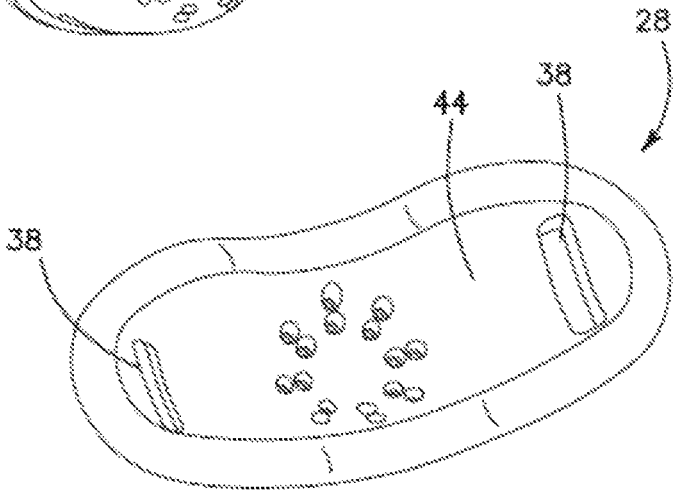
FIG. 6C is a top down perspective view of the chin guard seen in FIG. 6A after an insert has been disposed over the internal surface of the chin guard.

Turning to FIGS. 6A-6C, greater detail of the guard 28 may be had. The guard 28 comprises a body 36 which is substantially concave in shape, specifically wherein the body 36 is sufficiently contoured to accommodate the chin of the user. Disposed on an inside surface of the body 36 is a magnet housing 40 and a secondary magnet housing 42. Each magnet housing 40, 42 is shaped to accommodate the magnet 20 in a friction or snap fit. In a preferred embodiment, the magnet 20 is disposed in the magnet housing 40 so that all magnetic interaction takes place at or near the center of the user's chin, however the magnet 20 may also be disposed in the secondary magnet housing 42 which is slightly off center from the user's chin, thereby leading to a modified method of use by the user. Alternatively, a magnet 20 may be disposed in both the magnet housing 40 and the secondary magnet housing 42 at the same time if desired. Also defined in the body 36 are a pair of apertures 38 which accommodate either end of the chin strap 24 there through. As best seen in FIG. 6C, the guard 28 further comprises an insert 44 preferably comprised of foam or other lightweight soft material. The insert 44 is substantially concave shaped like the body 36 which allows the insert 44 to make a tight or snug fit therein. When in place, the insert 44 locks the magnet 20 into the magnet housing 40, 42 thereby preventing the magnet 20 from coming loose during repeated use while at the same time protecting the user's chin from any unwanted shock or vibration.

To use the apparatus 10, the user 16 places the head piece 12 over their chin may be stretching the head band 22 over the back of their head and then adjusting the chin strap 12 so that the guard 28 is sufficiently placed either on or below the user's chin as seen in FIG. 4. The user 16 also applies or couples the shoulder button 14 to their "back" shoulder by attaching the shoulder button 14 to their clothing at the desired position. The shoulder button 14 is preferably coupled to the user's clothing by inserting or threading the clothing with a needle or other sharp object that is disposed on a back surface of the shoulder button 14, much like a safety pin as is known in the art. However the shoulder button 14 may be coupled to different portions of the user's clothing using removable adhesive, corresponding patches of hook and loop fabric, snap buttons, or alternatively sewn or incorporated into the fabric of the user's clothing itself. "Back" or "rear" shoulder is defined as the shoulder which is further away from the ball being struck, therefore for left-handed users, their left shoulder is the "back" shoulder, while for right-handed users, their right shoulder is their "back" shoulder as demonstrated by the user seen in FIGS. 5A-5 D. With the head piece 12 and shoulder button 14 in their proper positions as seen in FIG. 4, the user 16 is ready to begin their swing training regimen.

Figure 5A:
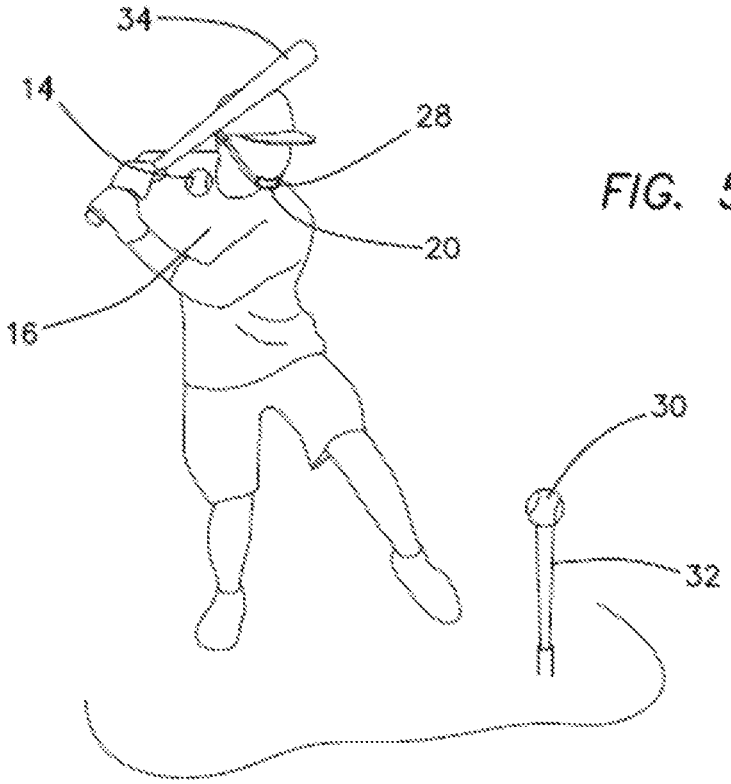
FIG. 5A is a side view of a user begin a training exercise by swinging a baseball bat at a ball disposed on a tee while wearing the apparatus seen in FIG. 4.
Figure 5B:
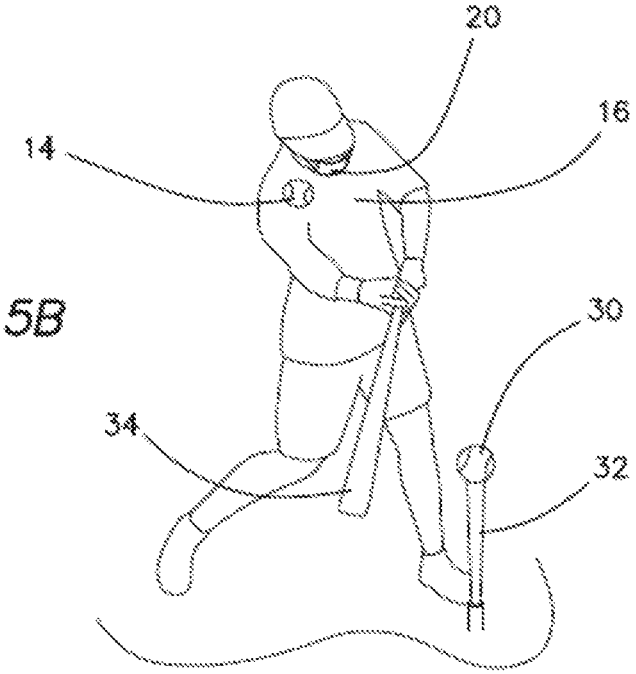
FIG. 5B is a side of the user seen in FIG. 5A about to make contact with the ball as the head piece portion worn by the user moves towards to the button.

Turning to FIG. 5A, the user 16 approaches the ball to be hit. As seen in FIG. 5A, the user 16 is specifically hitting a baseball 30 off of a tee 32 using a baseball bat 34, however it is to be expressly understood that other training configurations such as taking batting practice from a pitching machine or another player, or a hitting a golf ball off a golf tee at a driving range may also be used in conjunction with the current apparatus 10. Furthermore, the current apparatus 10 may be used in any number of other sports or physical activities where keeping the user's head down would be beneficial during a training exercise including but not limited to volleyball, yoga, or physical therapy among nearly countless others.

Figure 5C:
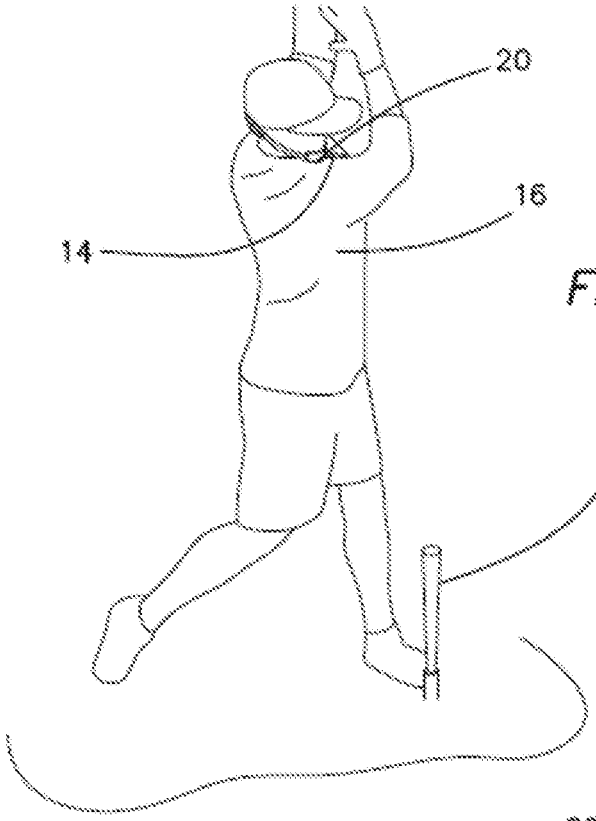
FIG. 5C is a side view of the user seen in FIG. 5B after the user has made contact with ball and after the head piece portion worn by the user has made contact with the button.
Figure 5D:
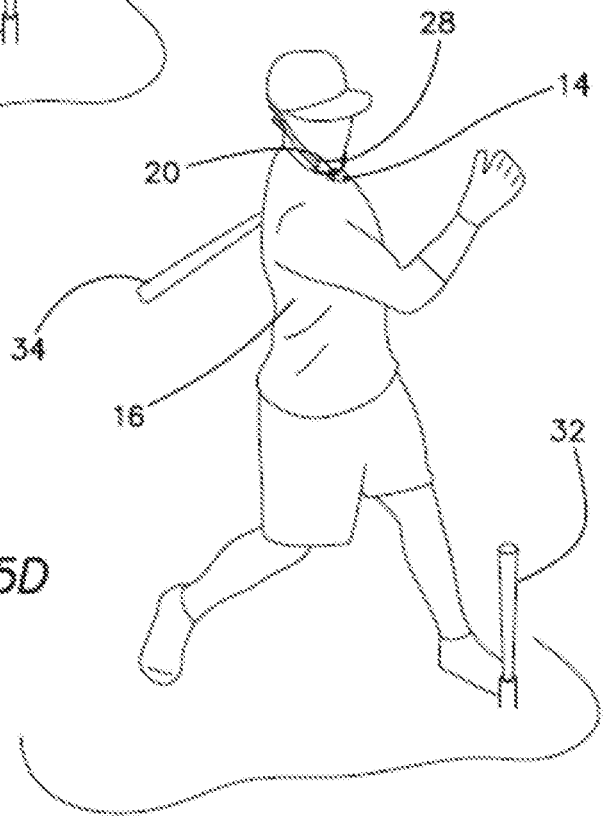
FIG. 5D is a side view of the user seen in FIG. 5C after the user has completed their swing while still maintaining sufficient contact between the head piece portion worn by the user and the button.

Returning to the current embodiment, the user begins their swing as seen in FIG. 5A with the shoulder button 14 disposed on their back shoulder. The user 16 continues their swing in FIG. 5B by bringing the bat 34 towards the ball 30. As the bat/golf club is brought towards the ball 30, the rotation of the user's back shoulder brings the shoulder button 14 forward towards the user's head and chin and thereby closer to the magnet 20 disposed on the guard 28. As seen in FIG. 5C, if the user 16 keeps their head and chin down and pointed towards the ball 32, the magnet 20 disposed on the guard 28 of the head piece 12 will approach the proximity of the shoulder button 14 and eventually, the magnetic forces between the magnet 20 the ferromagnetic material of the shoulder button 14 will draw the shoulder button 14 into the magnet 20 and attach thereto. When the surface of the magnet 20 makes contact with the shoulder button 14, an audible "click" or other sound is emitted which effectively signals to the user 16 that contact between the shoulder button 14 and the magnet 20 disposed at or near their chin has been achieved, thereby confirming that the user 16 has properly kept their head down throughout the movement of their swing. The magnetic force or hold between the magnet 20 and the shoulder button 14 is sufficiently strong enough so that even when the user 16 follows through or completes their swing as seen in FIG. 5D, the shoulder button 14 remains magnetically adhered to the magnet 20 of the head piece 12, thereby giving further confirmation that the user 16 has kept their head and chin in the down position throughout the duration of their swing. Conversely, if the user 16 pulls their head up or away from the ball 30 during their swing, the magnet 20 disposed on the distal portion of the guard 28 portion of the head piece 12 and the shoulder button 14 do not come into close proximity with each other and therefore do not interact with one another. As a result, a user 16 who pulls their head away during their swing will not hear an audible "click: or signal during their swing and even more telling, will not find the shoulder button 14 removably attached to the magnet 20 after their swing has been completed.

If after the user 16 has kept their head down during their swing, the user 16 may then reset and repeat the process by pulling the shoulder button 14 away from guard 28 portion of the head piece 12 which detaches the shoulder button 14 from the magnet 20. The user 16 may then step back and prepare to perform another swing. By repeating this process multiple times, the user 16 will continually receive feedback over whether or not they are properly keeping their head down during their swing, thus allowing the user to correct their performance accordingly if the magnet 20 and shoulder button 14 do not make contact. Over time, a user 16 using the apparatus 10 will quickly and effectively train their physical behavior so that keeping their head down during a swing will become automatic, even when the apparatus is subsequently not worn by the user 16. The end result therefore for the user 16 in using the apparatus 10 is to improve their overall athletic ability and compete at a higher level within their sport or hobby.

In another embodiment, the button 14 may be incorporated into a necklace or held on a belt or cord and worn about the user's neck so as to initially place the button 14 at or near a center portion of the user's chest. The user may then attach the magnet 20 to the button 14 by bringing the button 14 up to the magnet 20 disposed next to their chin before starting a training session. The user then performs their training session or regimen with the goal of keeping their head down to the extent that they do not lose contact with the button 14 or otherwise break the connection between the button 14 and the magnet 20 for the duration of their training session. If the user pulls their head too far while training, the force of the user's movement will overcome the magnetic force between the magnet 20 and the button 14, thereby resulting in a disconnection in the same manner outlined in the previous embodiment.

Many alterations and modifications may be made by those having ordinary skill in the art without departing from the spirit and scope of the embodiments. Therefore, it must be understood that the illustrated embodiment has been set forth only for the purposes of example and that it should not be taken as limiting the embodiments as defined by the following embodiments and its various embodiments.

Therefore, it must be understood that the illustrated embodiment has been set forth only for the purposes of example and that it should not be taken as limiting the embodiments as defined by the following claims. For example, notwithstanding the fact that the elements of a claim are set forth below in a certain combination, it must be expressly understood that the embodiments includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the embodiments is explicitly contemplated as within the scope of the embodiments.

The words used in this specification to describe the various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what essentially incorporates the essential idea of the embodiments.

I claim:

1. An apparatus for assisting a user perform a training regimen comprising:

a guard removably coupled to a head or chin portion of the user; and a button selectively coupled to a first position on the user, wherein the guard comprises a coupling means configured to temporarily couple to the button when the guard and button are brought in close proximity to one another during a performance of the training regimen, and wherein the button is configured to be removed from the first position on the user and selectively recoupled to a second position on the user.

2. The apparatus of claim 1 wherein the coupling means of the guard comprises a magnet disposed on a distal portion of the guard.

3. The apparatus of claim 1 further comprising a head piece configured to fit around the head and chin of the user, wherein the guard is further coupled to the head piece so as to be disposed about the chin of the user when the head piece is worn by the user.

4. The apparatus of claim 3 wherein the head piece comprises a head band coupled to a chin strap, wherein the guard is disposed on a center portion of the chin strap.

5. The apparatus of claim 1 wherein the button comprises a coupling means configured to removably couple the button to the first position on the user and to removably couple the button to the second position on the user.

6. The apparatus of claim 1 wherein the button is comprised of ferromagnetic material.

7. The apparatus of claim 1 wherein the coupling means emits an audible signal when the guard and the button are brought in close proximity to one another during the performance of training regimen.

8. A method for assisting a user perform a training regimen comprising:

disposing an automatic coupling means on a head or chin portion of the user;

selecting a first portion of the user to dispose a removable surface;

coupling the removable surface to the first selected portion of the user;

performing a motion which brings the first selected portion of the user into proximity with the head or chin portion of the user; and automatically engaging the coupling means disposed on the head or chin portion of the user to the surface disposed on the first selected portion of the user if the head or chin portion of the user has remained in close proximity to the shoulder first selected portion of the user during the performance of the motion.

9. The method of claim 8 further comprising preventing engagement between the coupling means disposed on the head or chin portion of the user and the surface disposed on the first selected portion of the user if the head or chin portion of the user is maintained at a distance from the first selected portion of the user.

10. The method of claim 8 wherein automatically engaging the coupling means disposed on the head or chin portion of the user to the surface disposed on the first selected portion of the user if the head or chin portion of the user has remained in close proximity to the first selected portion of the user during the performance of the motion comprises adhering the coupling means disposed on the head or chin portion of the user automatically to the surface disposed on the first selected portion of the user if the coupling means has made contact with the surface.

11. The method of claim 10 further comprising maintaining contact between the coupling means disposed on the head or chin portion of the user and the surface disposed on the first selected portion of the user throughout the duration of the performed motion.

12. The method of claim 10 further comprising separating the coupling means disposed on the head or chin portion of the user from the surface disposed on the first selected portion of the user by pulling the coupling means and the surface away from each other until the coupling means disengages from the surface.

13. The method of claim 10 wherein adhering the coupling means disposed on the head or chin portion of the user automatically to the surface disposed on the first selected portion of the user if the coupling means has made contact with the surface comprises coupling the coupling means to the surface with a magnet.

14. The method of claim 8 wherein disposing an automatic coupling means on a head or chin portion of the user comprises disposing a guard at or around the chin of the user, wherein the automatic coupling means are disposed on a distal end of the guard.

15. The method of claim 14 wherein disposing a guard at or around the chin of the user comprises stretching a head band around the head of the user and adjusting a chin strap coupled to the head band so that the guard disposed on a center portion of the chin strap is disposed at or around the chin of the user.

16. The method of claim 8 further comprising removing the removable surface to a from the first selected portion of the user and coupling the removable surface to a second selected portion of the user.

17. The method of claim 8 wherein disposing the removable surface on a first selected portion of the user comprises inserting a portion of the removable surface through a portion of the user's clothing disposed at the first selected portion of the user.

18. The method of claim 8 further comprising emitting an audio or visual signal to the user when the coupling means disposed on the head or chin portion of the user has engaged with the surface disposed on the first selected portion of the user.

19. A system for assisting a user perform a training regimen comprising:

a head piece comprising a chin strap;

a guard coupled to the chin strap;

a coupling means coupled to a distal portion of the guard; and a removable button configured to be worn by the user at a first selected portion of the user's body, wherein the removable button is configured to be removed from the first selected portion of the user's body and worn by the user at a selected portion of the user's body.

20. The system of claim 19 wherein the coupling means comprises a magnet and wherein the removable button is comprised of a ferromagnetic material.

* * * * *